US008049770B2

(12) United States Patent
Matsuda et al.

(10) Patent No.: US 8,049,770 B2
(45) Date of Patent: Nov. 1, 2011

(54) PRINTING APPARATUS

(75) Inventors: Okiharu Matsuda, Shizuoka (JP); Kazuyuki Yoshikoshi, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 40 days.

(21) Appl. No.: 12/479,011

(22) Filed: Jun. 5, 2009

(65) Prior Publication Data

US 2009/0309948 A1 Dec. 17, 2009

(30) Foreign Application Priority Data

Jun. 12, 2008 (JP) ..... 2008-154293
Jun. 19, 2008 (JP) ..... 2008-160604

(51) Int. Cl.
*B41J 2/32* (2006.01)

(52) U.S. Cl. ..... 347/171; 347/218

(58) Field of Classification Search ..... 347/19, 347/20, 171, 218
See application file for complete search history.

(56) References Cited

U.S. PATENT DOCUMENTS

| | | | | |
|---|---|---|---|---|
| 5,786,828 | A | 7/1998 | Yamamoto | |
| 6,113,213 | A * | 9/2000 | Hosaka | 347/20 |
| 2009/0309945 | A1 | 12/2009 | Matsuda | |
| 2009/0309950 | A1 | 12/2009 | Matsuda | |

FOREIGN PATENT DOCUMENTS

| | | |
|---|---|---|
| EP | 0751003 | 1/1997 |
| EP | 0780236 | 6/1997 |
| EP | 1661711 | 5/2006 |
| JP | 11-078083 | 3/1999 |
| JP | 2003054019 | 2/2003 |
| JP | 2007-030263 | 2/2007 |
| JP | 2007030263 | 2/2007 |
| JP | 2008187790 | 8/2008 |

OTHER PUBLICATIONS

European Search Report For 09007357.8-1251 Mailed Oct. 7, 2009.

* cited by examiner

*Primary Examiner* — Huan Tran
(74) *Attorney, Agent, or Firm* — Turocy & Watson, LLP

(57) ABSTRACT

A printing apparatus includes a pulse motor which operates to carry a recording medium, a thermal head to print on the recording medium, a pulse motor control unit which controls the pulse motor so that the pulse motor is operated at a carrying velocity based on a print ratio of input print data, a head control unit which controls the thermal head in a first or second head control mode, a head detection unit which detects the type of thermal head attached in the printing apparatus and a judgment unit which judges on the basis of the type of head detected by the head detection unit whether to control the thermal head by the first head control mode or the second head control mode.

5 Claims, 7 Drawing Sheets

PRINTING APPARATUS

CROSS-REFERENCE TO RELATED APPLICATION

This application is based upon and claims the benefit of priority from prior Japanese Patent Applications No. 2008-154293, filed Jun. 12, 2008; and No. 2008-160604, filed Jun. 19, 2008, the entire contents of both of which are incorporated herein by reference.

TECHNICAL FIELD

The present invention relates to a printing apparatus equipped with a thermal head.

BACKGROUND

Conventional printing apparatuses include, for example, a thermal printer equipped with a thermal head which has a plurality of heating elements arranged in the width direction of paper to be printed on. The thermal printer is generally driven by electric power of a battery. The thermal head is replaceable and detachable from the main body of the thermal printer.

Jpn. Pat. Appln. KOKAI Publication No. 2007-30263 describes the configuration of a thermal printer, wherein when printing is performed, heating elements corresponding to printing parts are heated among a plurality of heating elements to enable printing of various kinds of information.

Jpn. Pat. Appln. KOKAI Publication No. 11-78083 describes the configuration of a printer having an intermediate substrate, wherein an intermediate connector having a connecting structure adapted to a head connector can be selected from a plurality of kinds of intermediate connectors and connected to the intermediate substrate so that thermal heads different in the kind of dot density can be exchanged.

In the thermal printer described in Jpn. Pat. Appln. KOKAI Publication No. 2007-30263, a platen roller provided opposite to a thermal head is moved step by step by a pulse motor to carry paper to the position where thermal head is located. The thermal head performs printing for one line in accordance with a one-step operation of the pulse motor.

There are a plurality of standards for thermal heads used in the thermal printers, such as a thermal head having a resolution of 203 dpi or a thermal head having a resolution of 300 dpi. The length of one side of one dot in the case of the thermal head of 203 dpi is different from that in the case of the thermal head of 300 dpi. However, the carrying distance for the one-step operation of the pulse motor is fixed unless a mechanical modification is made. Therefore, for example, when the head having a resolution of 203 dpi is mounted on a thermal printer equipped with a mechanism adapted to the head having a resolution of 300 dpi, the problem is that the longitudinal and lateral lengths of a printed dot are different from each other.

In order to adapt the mechanism to each head, a plurality of kinds of mechanisms have to be attached. In this case, the problem is that the apparatus is increased in size and cost is increased.

Furthermore, Jpn. Pat. Appln. KOKAI Publication No. 11-78083 shows that a plurality of kinds of thermal heads are exchanged in the thermal printer, but does not describe any configuration for identifying the kind of attached thermal head.

It is therefore an object of the present invention to provide a printing apparatus which can adapt to a plurality of kinds of heads.

SUMMARY

According to one aspect of the present invention, there is provided a printing apparatus comprising: a pulse motor which operates to carry a recording medium; a thermal head to print on the recording medium; a pulse motor control unit which controls the pulse motor so that the pulse motor is operated at a carrying velocity based on a print ratio of input print data; a head control unit which controls the thermal head in a first or second head control mode; a head detection unit which detects the type of thermal head attached in the printing apparatus; and a judgment unit which judges on the basis of the type of head detected by the head detection unit whether to control the thermal head by the first head control mode or the second head control mode.

DETAILED DESCRIPTION

A first embodiment is described below with reference to the drawings.

Figure 1:
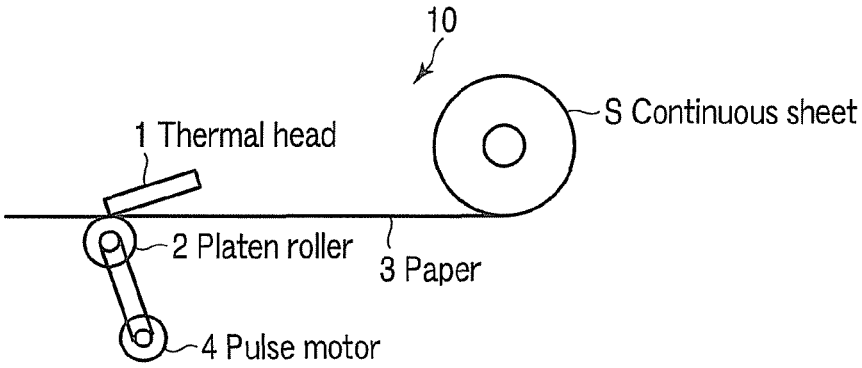
FIG. 1 is a diagram showing a schematic configuration of a thermal printer according to a first embodiment.

FIG. 1 is a diagram showing a schematic configuration of a thermal printer (portable printer) 10 in the first embodiment. The thermal printer 10 comprises a thermal head 1 and a platen roller 2. The thermal head 1 and the platen roller 2 hold, in between, paper 3 supplied from a wound continuous sheet S (e.g., receipt paper), and are provided opposite to each other. The present embodiment is described on the assumption that either a thermal head having a resolution of 203 dpi or a thermal head having a resolution of 300 dpi is attached as the thermal head 1.

The thermal head 1 is urged by an unshown urging member so that one end is rotatably supported and the other end is pressed into contact with the platen roller 2. The platen roller 2 is coupled to a pulse motor 4 via a belt and a mechanism for transmitting the operation of the pulse motor 4 to the platen roller 2. When the pulse motor 4 is rotated, the platen roller 2 is rotated by the belt together with the rotation of the pulse motor 4.

The paper 3 is carried between the thermal head 1 and the platen roller 2 by the rotation of the platen roller 2. The thermal head 1 has a plurality of heating elements arranged in the width direction of the continuous sheet S. The thermal head 1 heats the heating elements corresponding to printing parts among the plurality of heating elements to enable printing of various kinds of information to be printed on the paper 3 which is thermal paper. In the present embodiment, a strobe signal is applied to the heating elements provided in the thermal head to heat the heating elements.

In addition, the rotating distance of the platen roller 2, that is to say, the carrying distance of the paper 3 for a one-step operation of the pulse motor is determined by the gear ratio of the above-mentioned mechanism.

Figure 2:
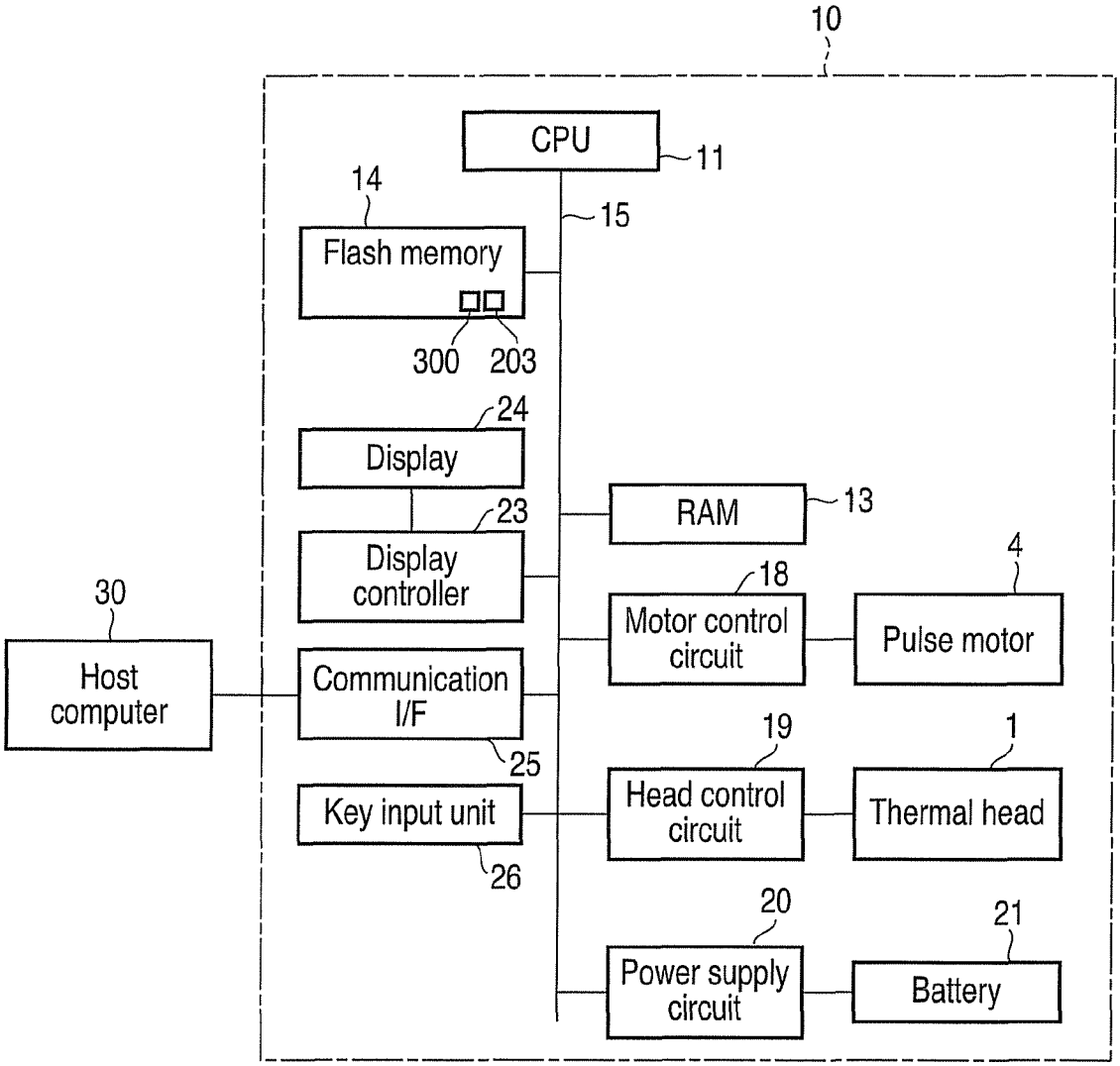
FIG. 2 is a block diagram showing the configuration of the thermal printer according to the first embodiment.

FIG. 2 is a block diagram showing the configuration of the thermal printer 10. The thermal printer 10 comprises a CPU 11 which executes various kinds of arithmetic processing and which controls various units in a concentrated manner. A RAM 13 and a memory including a flash memory 14 are connected to the CPU 11 via a system bus 15.

The flash memory 14 stores an operation program for the thermal printer 10. The CPU 11 copies the operation program stored in the flash memory 14 into the RAM 13 and executes the operation program to control the various units. The operation program includes a head control program 203 for the thermal head having a resolution of 203 dpi, and a head control program 300 for the thermal head having a resolution of 300 dpi.

When started, the CPU 11 first examines the state of the thermal printer 10. Here, the CPU 11 detects the type of attached thermal head 1. That is to say, the CPU 11 transmits, to the thermal head 1, a number of clock signals corresponding to the maximum number of dots constituting the thermal head 1 adapted to the thermal printer 10. Here, the CPU 11 transmits the strobe signal simultaneously with the transmission of a first high of the clock signal.

The strobe signal is set high for the first dot only, and set low for the second dot and the following dots. Thus, the CPU 11 can recognize the type, that is to say, the resolution of the thermal head 1 by monitoring an output signal of the thermal head 1.

For example, when a high is output from the thermal head synchronously with the 384th high from the start of the input of the clock signal, the CPU 11 judges that the resolution of the thermal head 1 is 203 dpi. When a high is output from the thermal head synchronously with the 1296th high from the start of the input of the clock signal, the CPU 11 judges that the resolution of the thermal head 1 is 300 dpi.

Thus, the CPU 11 detects the type of attached thermal head 1; the thermal head having a resolution of 203 dpi or the thermal head having a resolution of 300 dpi. That is to say, the CPU 11 functions as a head detection unit.

When detecting that the type of attached thermal head 1 is the thermal head having a resolution of 203 dpi, the CPU 11 starts the head control program 203. When detecting that the type of attached thermal head 1 is the thermal head having a resolution of 300 dpi, the CPU 11 starts the head control program 300.

The RAM 13 temporarily stores various kinds of variable information. Part of the area in the RAM 13 is used as a printing buffer in which print data (image data) to be printed on the paper 3 is expanded. The print data is data received from a host computer 30 and is to be printed. In addition, the print data may be stored in the flash memory 14.

A motor control circuit 18, a head control circuit 19 and a power supply circuit 20 are also connected to the CPU 11.

The motor control circuit 18 drives the pulse motor 4 under the control of the CPU 11. For example, the motor control circuit 18 controls the velocity of the operation of the pulse motor 4 in accordance with the print ratio of the print data. That is to say, the CPU 11 and the motor control circuit 18 function as a pulse motor control unit.

In addition, the print ratio is the ratio of the heating elements to which the strobe signal is applied among the plurality of heating elements of the thermal head. That is to say, the print ratio is the ratio of a printing area in a printable range of the paper 3.

Under the control of the CPU 11 executing the head control program, the head control circuit 19 applies the strobe signal to the heating elements provided in the thermal head 1 in accordance with the print data expanded in the printing buffer of the RAM 13, thereby performing printing on the paper 3. That is to say, the CPU 11 and the head control circuit 19 function as a head control unit. The power supply circuit 20 supplies the various units with electric power accumulated in a battery 21, and thus operates the various units.

A display controller 23, a communication interface 25 and a key input unit 26 are also connected to the CPU 11.

The display controller 23 controls the display operation in a display 24 under the control of the CPU 11. The display 24 displays various kinds of information such as a printing status.

The communication interface (I/F) 25 is an interface for communicating with an external device such as the host computer 30 (host device). The communication interface 25 is configured by, for example, an infrared communication such as IrDA, a universal serial bus (USB), a local area network (LAN), RS-232C or bluetooth (registered trademark). The communication interface 25 is capable of communicating with a communication interface provided in the host computer 30.

The key input unit 26 includes various keys by which a user inputs an operation to the thermal printer 10.

The host computer 30 is configured by, for example, a personal computer (PC), a mobile telephone or a handy terminal. The host computer 30 executes arithmetic processing in accordance with the operation input by the user.

Next, the operation of the above-mentioned head control program is described.

Figure 3:
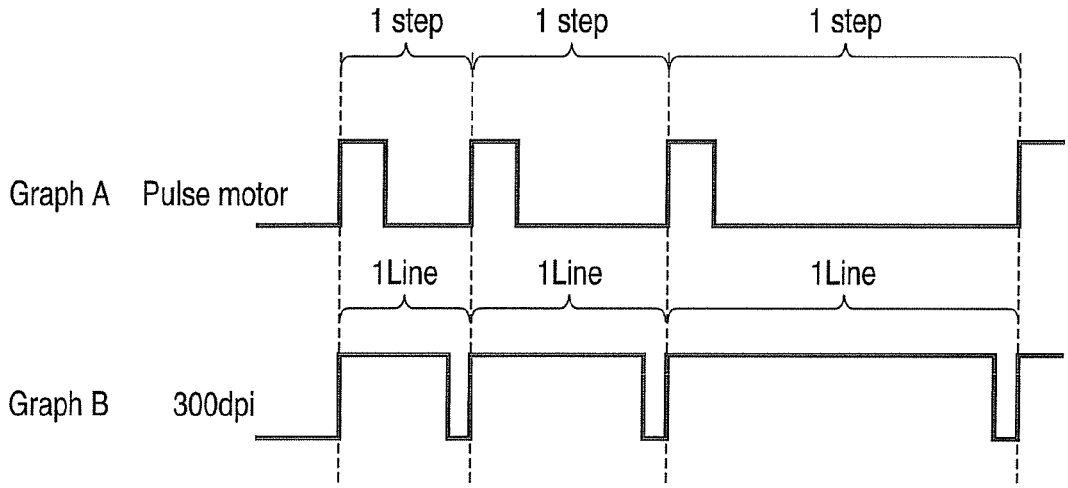
FIG. 3 is a time chart for explaining the operation of a head control program according to the first embodiment.

FIG. 3 is a time chart for explaining the operation of the head control program 300 corresponding to the thermal head having a resolution of 300 dpi.

A graph A in FIG. 3 is a time chart showing the operation of the pulse motor 4. A graph B in FIG. 3 is a time chart showing the operation in the case where the CPU 11 executes the head control program 300. In addition, when the pulse motor 4 is operated step by step, the paper 3 is carried a distance for one line of the thermal head having a resolution of 300 dpi.

The CPU 11 first calculates a print ratio of print data per line. On the basis of the calculated print ratio, the CPU 11 calculates a conducting time of the thermal head 1 per line. On the basis of the calculated conducting time, the CPU 11 calculates a carrying velocity of the pulse motor 4 per step. That is to say, the CPU 11 calculates a carrying velocity of the pulse motor 4 for one step so that the pulse motor 4 operates one step during the conducting time for one line.

In the case of, for example, a line with a high print ratio, the conducting time of the thermal head 1 is long, so that the CPU 11 sets a lower carrying velocity of the pulse motor 4 for one step accordingly. In the case of, for example, a line with a low print ratio, the conducting time of the thermal head 1 can be short, so that the CPU 11 sets a high carrying velocity of the pulse motor 4 for one step.

As described above, when the CPU 11 executes the head control program 300, the CPU 11 controls the motor control circuit 18 and the head control circuit 19 so that one step of the pulse motor 4 is synchronized with the printing of one line by the thermal head 1. That is to say, the CPU 11 and the head control circuit 19 perform control in accordance with a first head control mode.

Figure 4:
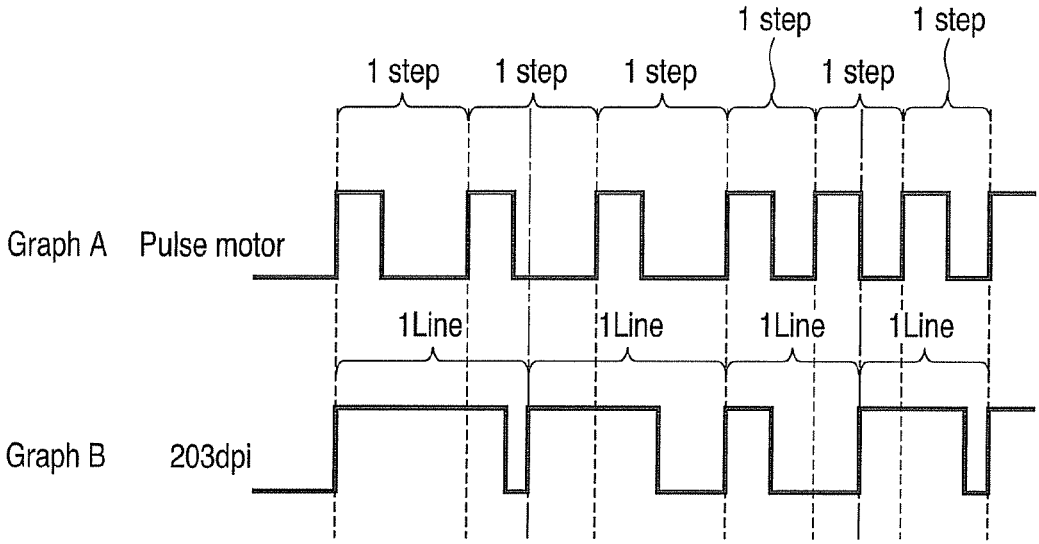
FIG. 4 is a time chart for explaining the operation of a head control program according to the first embodiment.

FIG. 4 is a time chart for explaining the operation of the head control program 203 corresponding to the thermal head having a resolution of 203 dpi.

A graph A in FIG. 4 is a time chart showing the operation of the pulse motor 4. A graph B in FIG. 4 is a time chart showing the operation in the case where the CPU 11 executes the head control program 203. In addition, when the pulse motor 4 is operated step by step, the paper 3 is carried a distance for one line of the thermal head having a resolution of 300 dpi. That is to say, the same mechanism as that in the example shown in FIG. 3 is used.

When executing the head control program 203, the CPU 11 first calculates a print ratio of print data per line. On the basis of the calculated print ratio per line, the CPU 11 calculates a conducting time of the thermal head 1 per line. The CPU 11 makes sets of two lines out of the lines of the print data from the head, and calculates double the conducting time of one of the two lines having a longer conducting time as processing time for two lines.

The CPU 11 calculates a carrying velocity of the pulse motor 4 every three steps on the basis of the processing time for two lines. That is to say, the CPU 11 calculates a carrying velocity of the pulse motor 4 for every three steps so that the pulse motor 4 operates three steps during the processing time for two lines. The motor control circuit 18 controls the carrying velocity of the pulse motor 4 for three steps on the basis of the carrying velocity calculated by the CPU 11.

When printing is performed, as shown in FIG. 4, the CPU 11 starts conducting the thermal head 1 for data of the first line simultaneously with the start of the first step of the three steps of the pulse motor 4, and the CPU 11 then starts conducting the thermal head 1 for data of the second line from the point where the pulse motor 4 has operated 1.5 steps.

As described above, when the CPU 11 executes the head control program 203, the CPU 11 controls the motor control circuit 18 and the head control circuit 19 so that three steps of the pulse motor 4 synchronize with the printing of two lines by the thermal head 1.

When executing the head control program 203, the CPU 11 calculates a carrying velocity of the pulse motor 4 every three steps on the basis of print ratio of print data for two lines. Thus, the pulse motor 4 carries the paper 3 at the same velocity in three steps, and at the point where the pulse motor 4 has finished the carrying for three steps, the pulse motor 4 is changed to the carrying velocity calculated on the basis of the print data for the next two lines. That is to say, the CPU 11 and the head control circuit 19 perform control in accordance with a second head control mode.

Figure 5:
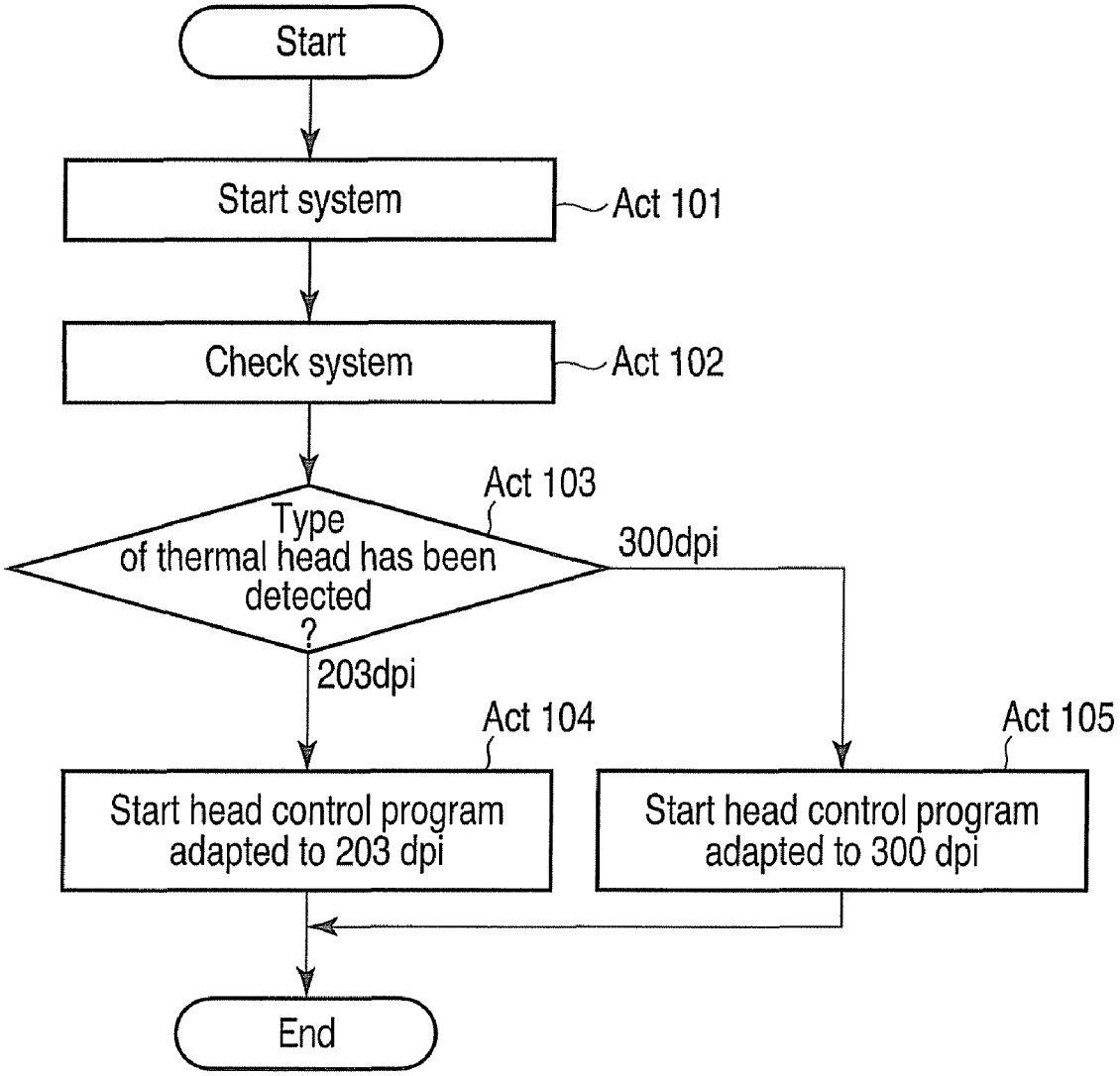
FIG. 5 is a flowchart for explaining processing for starting the thermal printer according to the first embodiment.

FIG. 5 is a flowchart for explaining processing for starting the thermal printer 10 shown in FIGS. 1 and 2.

When the thermal printer 10 is powered on, a system is started (Act101). That is to say, the CPU 11 reads various programs from the flash memory 14, and expands the programs in the RAM 13.

When the system is started, the CPU 11 checks the system (Act102). That is to say, the CPU 11 examines the state of each unit in the thermal printer 10. Here, the CPU 11 detects the type of attached thermal head 1; the thermal head having a resolution of 203 dpi or the thermal head having a resolution of 300 dpi (Act103).

When detecting that the type of attached thermal head 1 is the thermal head having a resolution of 203 dpi, the CPU 11 starts the head control program 203 from the flash memory 14, and expands the program in the RAM 13 (Act104).

When detecting that the type of attached thermal head 1 is the thermal head having a resolution of 300 dpi, the CPU 11 starts the head control program 300 from the flash memory 14, and expands the program in the RAM 13 (Act105). That is to say, the CPU 11 functions as a judgment unit for judging the head control program to be started on the basis of the head type detection result.

Figure 6:
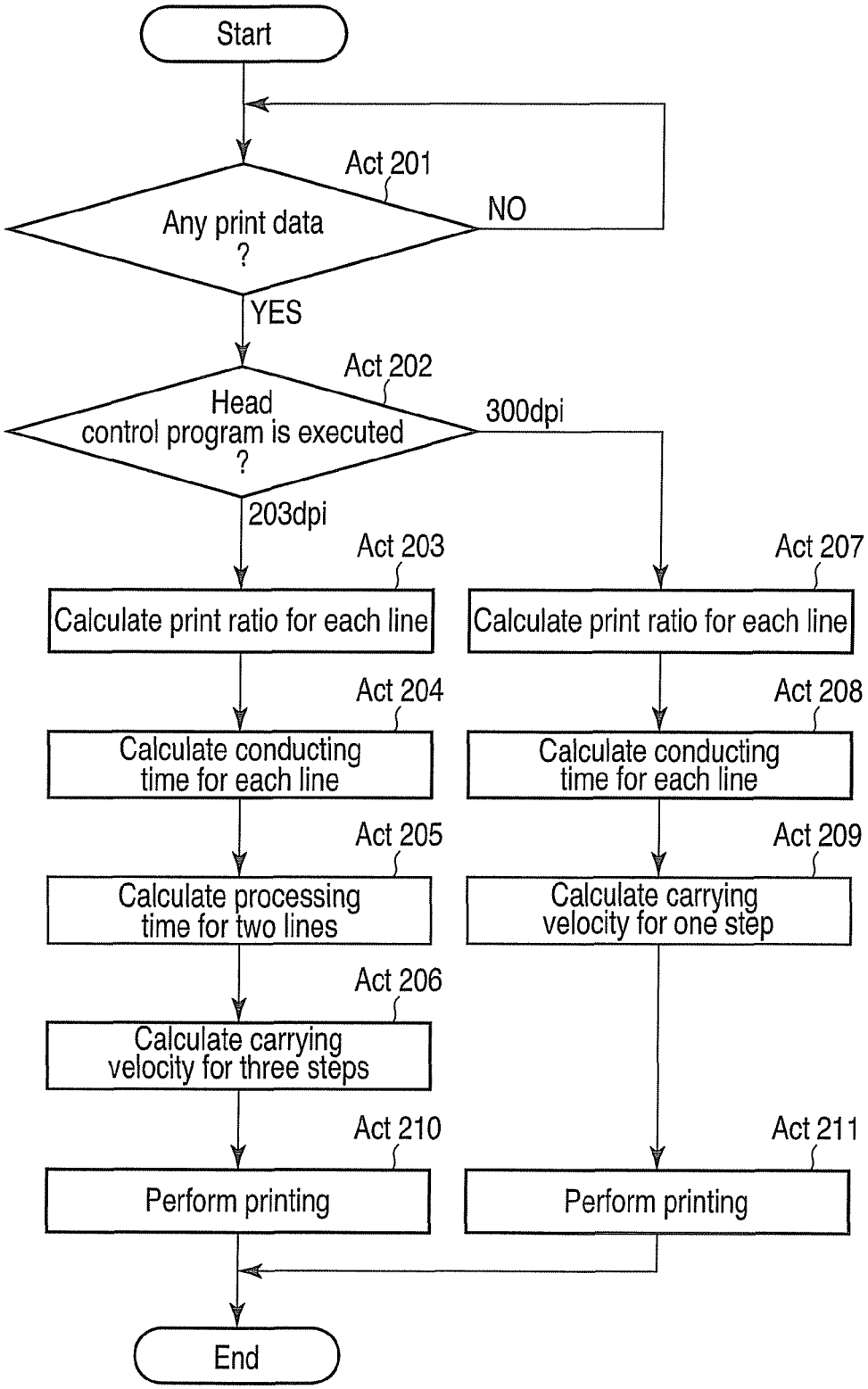
FIG. 6 is a flowchart for explaining processing for printing by the thermal printer according to the first embodiment.

FIG. 6 is a flowchart for explaining processing for printing by the thermal printer 10 shown in FIGS. 1 and 2.

When started, the CPU 11 of the thermal printer 10 waits for print data to be received (Act201). On receipt of the print data (Act201, YES), the CPU 11 executes the head control program expanded in the RAM 13 (Act202).

When the head control program expanded in the RAM is the head control program 203, the CPU 11 first calculates a print ratio of print data per line (Act203). On the basis of the calculated print ratio per line, the CPU 11 calculates a conducting time of the thermal head 1 per line (Act204).

The CPU 11 makes sets of two lines out of the lines of the print data from the head, and calculates double the conducting time of one of the two lines having a longer conducting time as processing time for two lines (Act205). The CPU 11 calculates a carrying velocity of the pulse motor 4 every three steps on the basis of the processing time for two lines (Act206).

After calculating the conducting time for one line of the print data and the carrying velocity of the pulse motor 4, the CPU 11 performs printing (Act210). That is to say, the CPU 11 starts conducting the thermal head 1 for data of the first line simultaneously with the start of the first step of the three steps of the pulse motor 4, and the CPU 11 then starts conducting the thermal head 1 for data of the second line from the point where the pulse motor 4 has operated 1.5 steps.

When the head control program expanded in the RAM is the head control program 300, the CPU 11 first calculates a print ratio of print data per line (Act207). On the basis of the calculated print ratio, the CPU 11 calculates a conducting time of the thermal head 1 per line (Act208). On the basis of the calculated conducting time, the CPU 11 calculates a carrying velocity of the pulse motor 4 per step (Act209).

After calculating the conducting time for one line of the print data and the carrying velocity of the pulse motor 4, the CPU 11 performs printing (Act211). That is to say, the CPU 11 starts conducting the thermal head 1 for data of the first line simultaneously with the start of the first step of the pulse motor 4. Subsequently, the CPU 11 controls the motor control circuit 18 and the head control circuit 19 so that the thermal head 1 is conducted for the data of each line synchronously with each step of the pulse motor 4.

After having printed all the lines of the print data, the CPU 11 ends the processing. Alternatively, the CPU 11 may move to Act201 to wait for the next print data to be received.

As described above, according to the first embodiment, the thermal printer 10 can use the common mechanism to adapt to the thermal heads 1 having a plurality of kinds of resolutions by controlling the carrying velocity of the pulse motor per step and the conducting time of the thermal head 1. For example, when either the head having a resolution of 203 dpi or the head having a resolution of 300 dpi is attached, a mechanism adapted to the head of the higher resolution, that is to say, the head that requires a lower carrying velocity is attached to the thermal printer. That is to say, in this case, a mechanism adapted to the head having a resolution of 300 dpi is attached.

When the head having a resolution of 203 dpi is mounted, the thermal printer 10 is controlled so that the conducting time of the thermal head 1 is synchronized with the operation of the pulse motor 4 at the point where the thermal printer 10 has carried the paper a distance equal to the least common multiple of the width of the dot of the head having a resolution of 203 dpi and the width of the dot of the head having a resolution of 300 dpi. That is to say, the width of the dot of the head having a resolution of 203 dpi is about 0.125 mm, and the width of the dot of the head having a resolution of 300 dpi is about 0.083 mm, so that the synchronization can be achieved at the point where the paper is carried about 0.250 mm.

According to the mechanism described above, the paper is carried 0.083 mm in one step, so that the synchronization can be achieved at the point where the paper has been carried three steps. When the head having a resolution of 300 dpi is mounted, the thermal printer 10 can print three lines while carrying the paper 0.250 mm, and therefore prints one line in one step. When the head having a resolution of 203 dpi is mounted, the thermal printer 10 can print two lines while carrying the paper 0.250 mm, and therefore prints two lines in three steps.

The configuration described above enables the thermal printer 10 to adapt to the thermal heads of a plurality of kinds of resolutions and perform printing without exchanging mechanisms. Consequently, it is possible to provide a printing apparatus and a printing apparatus control method which can adapt to a plurality of kinds of heads at low cost.

The first embodiment has been described on the assumption that either the thermal head having a resolution of 203 dpi or the thermal head having a resolution of 300 dpi is attached as the thermal head 1. The first embodiment, however, is not limited thereto. A combination of thermal heads having any resolutions can be applied as long as the dot widths of such thermal heads can have the least common multiple.

For example, when any one of a head having one dot 0.06 mm in width, a head having one dot 0.05 mm in width and a head having one dot 0.10 mm in width is mounted, the thermal printer 10 is controlled so that the synchronization is achieved at 0.30 mm which is the least common multiple of these dot widths. In this case, in order to adapt to the head having a dot width of 0.05 mm, a mechanism is used which carries the paper 0.05 mm every time the pulse motor 4 operates one step. In this case, the synchronization is achieved in six steps.

That is to say, the head having one dot 0.06 mm in width prints five lines in six steps. The head having one dot 0.05 mm in width prints six lines in six steps. The head having one dot 0.10 mm in width prints three lines in six steps. The thermal head and the pulse motor are controlled as described above, such that, in the first embodiment, a combination of thermal heads having any resolutions can be applied as long as the dot widths of such thermal heads can have the least common multiple.

Figure 7:
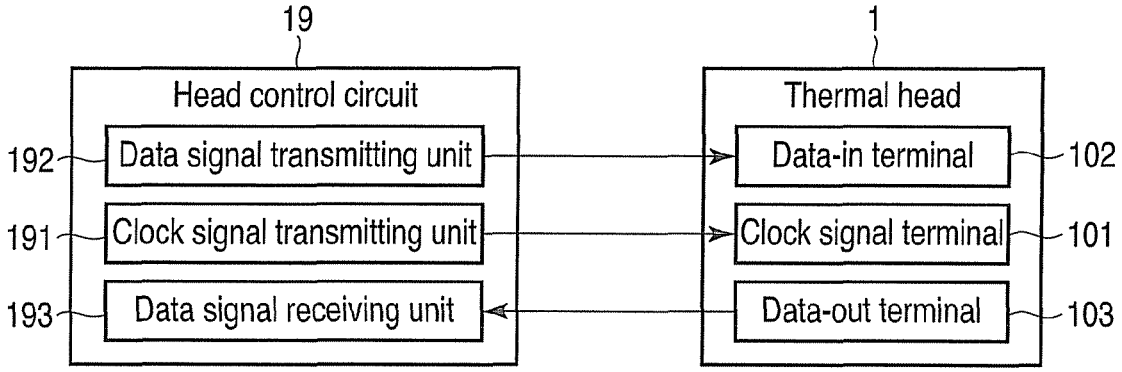
FIG. 7 is a block diagram showing a head control circuit and a thermal head according to a second embodiment.

Now, a second embodiment is described. The configuration of a thermal printer 10 according to the second embodiment is similar to the configuration of the thermal printer 10 according to the first embodiment shown in FIG. 2, and is therefore not shown. FIG. 7 is a block diagram showing a head control circuit 19 according to the second embodiment in concrete form.

The head control circuit 19 includes a clock signal transmitting unit 191, a data signal transmitting unit 192 and a data signal receiving unit 193. A thermal head 1 includes a clock signal terminal 101, a data-in terminal 102 and a data-out terminal 103. The data-in terminal 102 is provided on one end of a plurality of heating elements arranged in the width direction of the thermal head 1. The data-out terminal 103 is provided on the other end of the plurality of heating elements arranged in the width direction of the thermal head 1.

The clock signal transmitting unit 191 transmits a high to the clock signal terminal 101 of the thermal head 1 at given periods so that a clock signal alternately becomes high and low at given periods. The data signal transmitting unit 192 transmits a data input signal to the data-in terminal 102 of the thermal head 1 in accordance with print data expanded in a printing buffer of a RAM 13. The data signal transmitting unit 192 transmits the data input signal by synchronous serial communication. The thermal head 1 achieves synchronization so that the data input signal is shifted one dot by the rising of the clock signal. The data signal receiving unit 193 receives a data output signal output from the data-out terminal 103 by the shift of the data input signal input to the thermal head 1. That is to say, a CPU 11 detects the data output signal received in the data signal receiving unit 193 and thereby judges whether printing has been correctly performed in the thermal head 1 on the basis of the data input signal.

Figure 9:
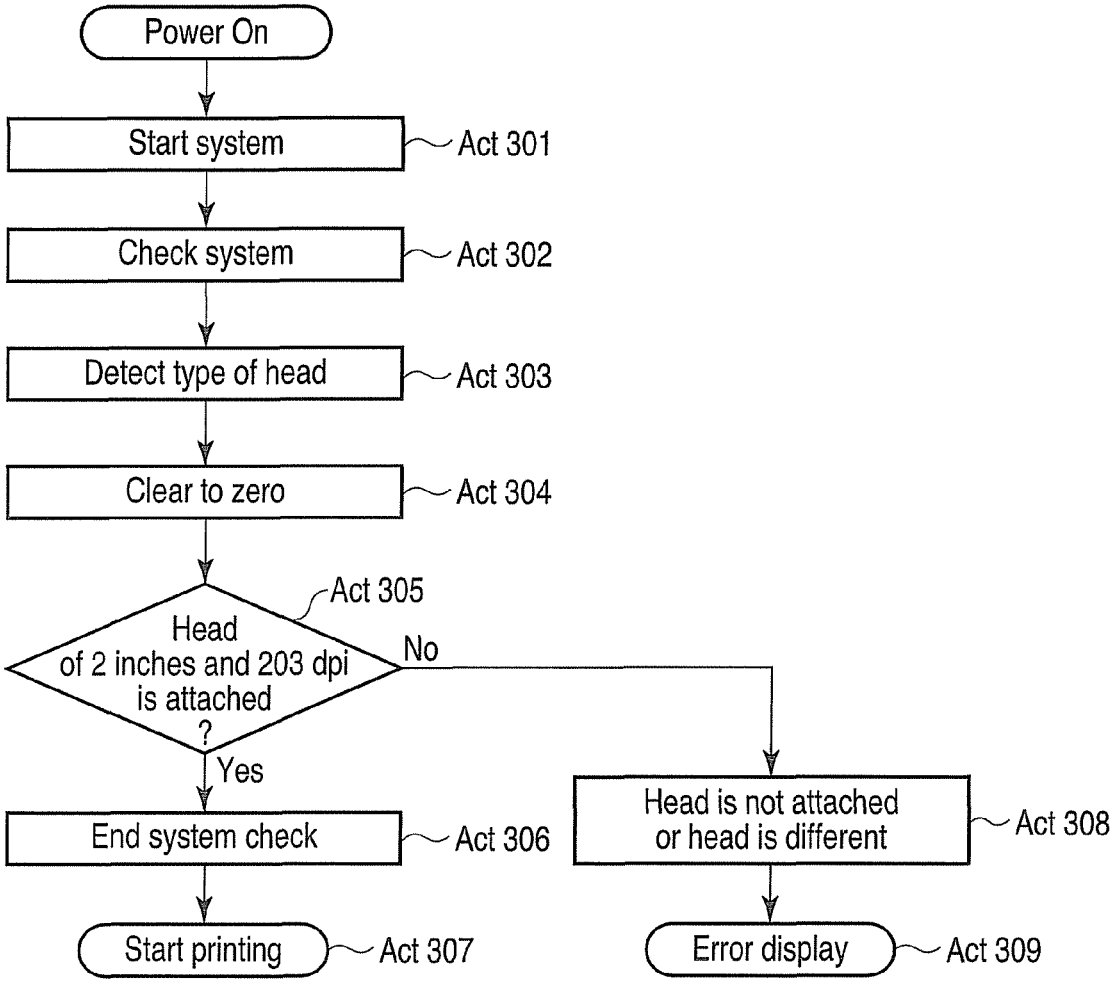
FIG. 9 is a flowchart for explaining processing for detecting the kind of thermal head according to the second embodiment.

FIG. 9 is a flowchart showing the detection of whether a particular kind of thermal head 1 is attached to the thermal printer 10 in which control adapted to the particular kind of thermal head 1 is set (in which an operation program is stored in a flash memory 14). The control adapted to the particular kind of thermal head 1 includes, for example, setting of resolution or a feed pitch.

There are prepared three kinds of thermal heads 1 which can be structurally and electrically attached to the thermal printer 10 and which correspond to sizes, resolutions and the number of dots as follows:

The first thermal head 1 has a size of 2 inches, a resolution of 203 dpi, and 384 dots. The second thermal head 1 has a size of 4 inches, a resolution of 203 dpi, and 832 dots. The third thermal head 1 has a size of 4 inches, a resolution of 300 dpi, and 1296 dots.

In the case described here, the thermal head 1 of the particular kind in which control adapted to the thermal printer 10 is set is the thermal head 1 having a size of 2 inches, a resolution of 203 dpi, and 384 dots.

First, when the thermal printer 10 is powered on, the CPU 11 starts systems of units constituting the thermal printer 10 (Act301). Further, the CPU 11 starts checking whether the systems of the units constituting the thermal printer 10 are normally operating (Act302).

Then, the CPU 11 starts detecting the kind of thermal head 1 attached to the thermal printer 10 (Act303).

The clock signal transmitting unit 191 transmits, to the clock signal terminal 101 of the thermal head 1, the number of lows corresponding to the maximum number of dots constituting the thermal head 1 adapted to the thermal printer 10. The number of lows transmitted as clock signals is 1296 which corresponds to the maximum number of dots in one thermal head 1 selected from the group consisting of the thermal head 1 having 384 dots, the thermal head 1 having 832 dots and the thermal head 1 having 1296 dots.

The clock signal transmitting unit 191 transmits 1296 lows to the clock signal terminal 101 of the thermal head 1. As a result, no high clock signal is transmitted among the 1296 lows are transmitted and the thermal head 1 is therefore cleared to zero (Act304).

Then, the CPU 11 judges whether the thermal head 1 having a size of 2 inches and a resolution of 203 dpi that are adapted to the thermal printer 10 is attached to the thermal printer 10 (Act305). The CPU 11 judges the kind of thermal head 1 as follows: Here, FIG. 8 shows a signal waveform input to the clock signal terminal 101, a signal waveform input to the data-in terminal 102, and a signal waveform output from the data-out terminal 103.

First, the clock signal transmitting unit 191 transmits a clock signal to the clock signal terminal 101. The data signal transmitting unit 192 transmits a data input signal synchronously with the timing whereby the clock signal transmitting unit 191 transmits a first high to the data-in terminal 102 of the thermal head 1 as shown in FIG. 8. The data input signal is set high for the first dot only, and set low for the second dot and the following dots. Further, the CPU 11 monitors the data output signal which the data signal receiving unit 193 has received from the data-out terminal 103.

Figure 8:
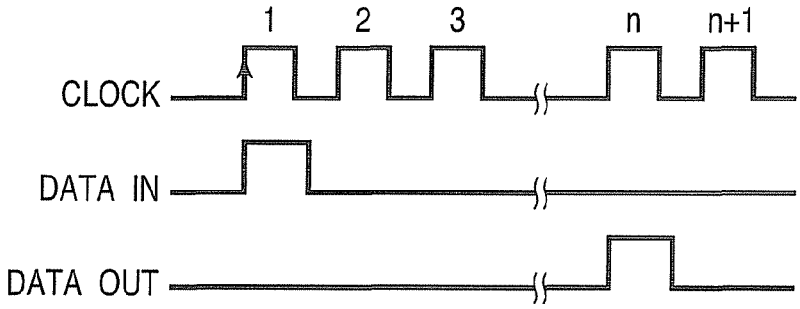
FIG. 8 shows a signal waveform input to a clock signal terminal, a signal waveform input to a data-in terminal, and a signal waveform output from a data-out terminal, according to the second embodiment.

As shown in FIG. 8, when receiving a high of the data output signal synchronous with the n-th clock signal from the start of input, the CPU 11 judges that the number of dots arranged in the thermal head 1 is n. Accordingly, the CPU 11 judges that a particular kind of thermal head 1 in which the number of dots is n is attached to the thermal printer 10.

Here, when the data signal receiving unit 193 receives a data output signal synchronous with the 384th high from the start of the input of the clock signal, the CPU 11 judges that the thermal head 1 having a size of 2 inches and a resolution of 203 dpi is attached to the thermal printer 10. That is to say, the CPU 11 functions as a judgment unit for judging the kind of thermal head 1 attached to the thermal printer 10.

When the CPU 11 judges that the thermal head 1 having a size of 2 inches and a resolution of 203 dpi is attached to the thermal printer 10 (Act305, YES), the CPU 11 ends the checking of the systems of the units constituting the thermal printer 10 (Act306). Further, the CPU 11 controls the thermal head 1 so that the thermal head 1 is ready to start printing (Act307).

When the CPU 11 judges that the thermal head 1 having a size of 2 inches and a resolution of 203 dpi is not attached to the thermal printer 10 (Act305, NO), the CPU 11 judges that the thermal head 1 is not attached to the thermal printer 10 or the thermal head 1 is not a particular kind of thermal head 1 (Act308). Further, the CPU 11 indicates on a display 24 via a display controller 23 that the thermal head 1 is not a particular kind of thermal head 1 (Act309). That is to say, the display 24 functions as a reporting unit for reporting that the particular kind of thermal head 1 is not attached to the thermal printer 10.

Figure 10:
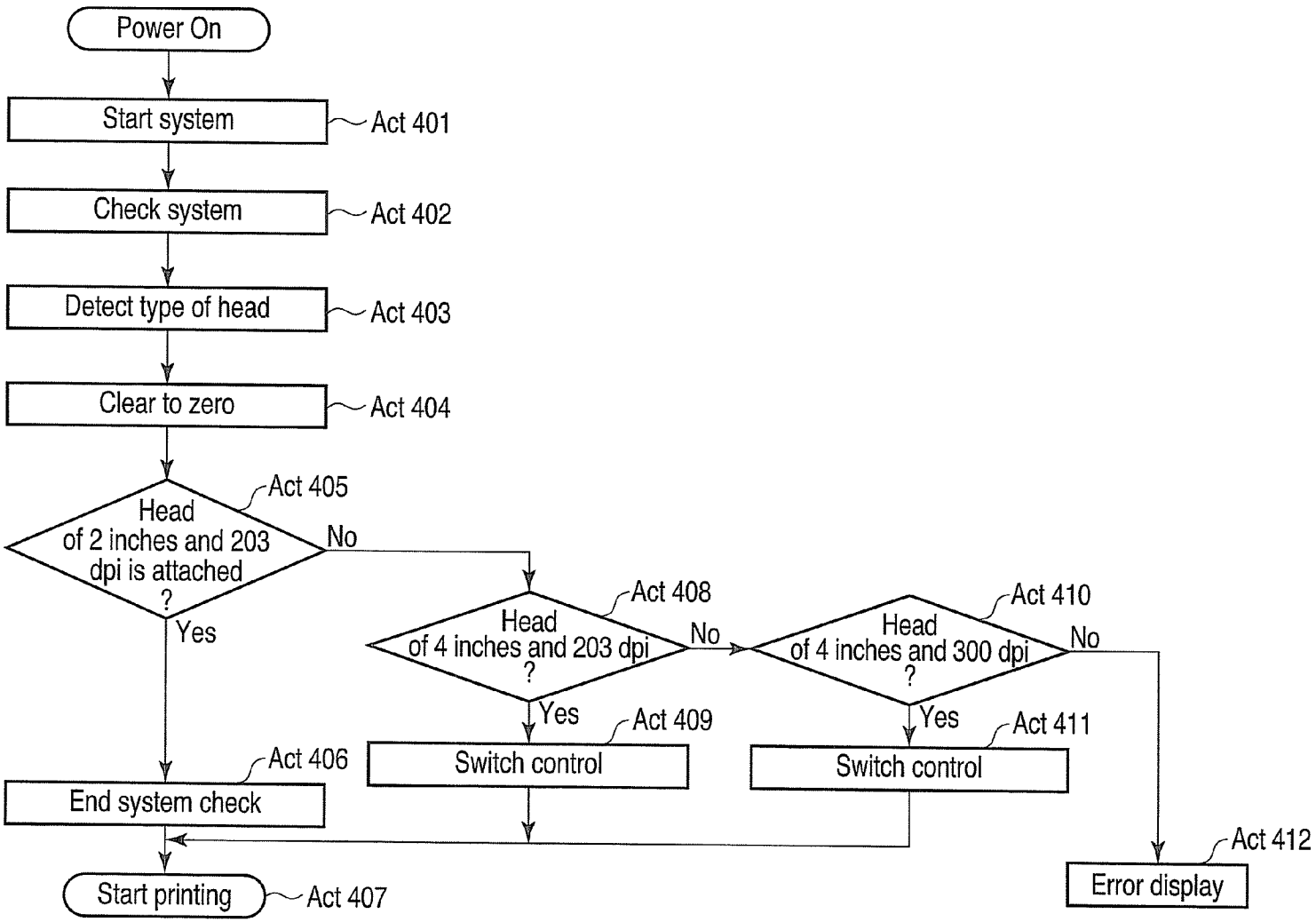
FIG. 10 is a flowchart for explaining a modification of the processing for detecting the kind of thermal head according to the second embodiment.

Next, the judgment of the kind of attached thermal head is described with a flowchart shown in FIG. 10 in connection with the case where the thermal head 1 is attached to the thermal printer 10.

After the thermal printer 10 is powered on, Act401 to Act407 are similar to Act301 to Act307 shown in FIG. 9, respectively, and are not described.

When the CPU 11 judges that the thermal head 1 having a size of 2 inches and a resolution of 203 dpi is not attached to the thermal printer 10 (Act405, NO), the CPU 11 judges in the following manner whether the thermal head 1 having a size of 4 inches and a resolution of 203 dpi is attached to the thermal printer 10 (Act408). That is to say, when the data signal receiving unit 193 receives a data output signal synchronous with the 832nd high from the start of the input of the clock signal, the CPU 11 judges that the thermal head 1 having a size of 4 inches and a resolution of 203 dpi is attached to the thermal printer 10.

When the CPU 11 judges that the thermal head 1 having a size of 4 inches and a resolution of 203 dpi is attached to the thermal printer 10 (Act408, YES), the CPU 11 switches the units constituting the thermal printer 10 to control setting adapted to the thermal head 1 having a size of 4 inches and a resolution of 203 dpi (Act409). That is to say, the CPU 11 functions as a switching unit for switching to the control setting adapted to the thermal head 1. Further, the CPU 11 controls the thermal head 1 so that the thermal head 1 is ready to start printing (Act407).

When the CPU 11 judges that the thermal head 1 having a size of 4 inches and a resolution of 203 dpi is not attached to the thermal printer 10 (Act408, NO), the CPU 11 judges in the following manner whether the thermal head 1 having a size of 4 inches and a resolution of 300 dpi is attached to the thermal printer 10 (Act410). That is to say, when the data signal receiving unit 193 receives a data output signal synchronous with the 1296th high from the start of the input of the clock signal, the CPU 11 judges that the thermal head 1 having a size of 4 inches and a resolution of 300 dpi is attached to the thermal printer 10.

When the CPU 11 judges that the thermal head 1 having a size of 4 inches and a resolution of 300 dpi is attached to the thermal printer 10 (Act410, YES), the CPU 11 switches the units constituting the thermal printer 10 to control setting adapted to the thermal head 1 having a size of 4 inches and a resolution of 300 dpi (Act411). Further, the CPU 11 controls the thermal head 1 so that the thermal head 1 is ready to start printing (Act407).

When the CPU 11 judges that the thermal head 1 having a size of 4 inches and a resolution of 300 dpi is not attached to the thermal printer 10 (Act410, NO), the CPU 11 judges that the thermal head 1 is not attached to the thermal printer 10 or a thermal head 1 other than the above-described three kinds of attachable thermal heads 1 is attached. Further, the CPU 11 indicates on the display 24 via the display controller 23 that this thermal head 1 is not proper (Act412).

As described above, a user can easily identify the kind of thermal head 1 attached to the thermal printer 10 without adding any particular configuration. Moreover, the user can set control suitable to the thermal head 1 attached to the thermal printer 10.

According to the second embodiment, the user can easily identify the kind of thermal head 1 attached to the thermal printer 10 without performing any particular operation and without adding any particular configuration. Moreover, the thermal printer 10 can be set to control suitable to the thermal head attached thereto.

The second embodiment may be combined with the first embodiment to serve as a third embodiment. Specifically, in Act103 of FIG. 5 in the first embodiment, the CPU 11 executes the flow shown in FIG. 9 in the second embodiment as a method of detecting whether the type of attached thermal head 1 is the thermal head 1 having a resolution of 203 dpi or the thermal head 1 having a resolution of 300 dpi.

According to the third embodiment, the thermal printer 10 can easily identify the kind of thermal head 1 attached thereto without performing any particular operation and without adding any particular configuration. Moreover, the thermal printer 10 can adapt to the thermal heads 1 having a plurality of kinds of resolutions and perform printing accordingly.

What is claimed is:

1. A printing apparatus comprising:

a pulse motor which operates to carry a recording medium;

a thermal head which prints on the recording medium;

a pulse motor control unit which controls the pulse motor so that the pulse motor is operated at a carrying velocity based on a print ratio of input print data;

a head control unit which controls the thermal head in a first or second head control mode;

a head detection unit which detects whether the thermal head attached in the printing apparatus is a first thermal head having a first resolution or a second thermal head having a second resolution; and a judgment unit which judges whether to control the thermal head by the first head control mode or the second head control mode according to the thermal head detected by the head detection unit being the first thermal head having the first resolution or the second thermal head having the second resolution.

2. The apparatus of claim 1 wherein:

the head control unit controls the thermal head by the first or second head control mode, the first head control mode being adapted to control the thermal head so that the thermal head performs printing one time while the pulse motor is operated one step by the pulse motor control unit, the second head control mode being adapted to control the thermal head so that the thermal head performs printing two times while the pulse motor is operated three steps by the pulse motor control unit.

3. The apparatus of claim 2 wherein:

when the head control unit controls the thermal head in the second head control mode, the pulse motor control unit controls a carrying velocity for three steps on the basis of a print ratio of the print data for two lines.

4. A method of controlling a printing apparatus equipped with a pulse motor used to carry a recording medium and with a thermal head which prints on the recording medium, the method comprising:

controlling the pulse motor so that the pulse motor is operated at a carrying velocity based on a print ratio of input print data;

detecting whether the thermal head attached in the printing apparatus is a first thermal head having a first resolution or a second thermal head having a second resolution; and judging whether to control the thermal head by a first head control mode or a second head control mode according to the detecting result, the first head control mode being adapted to control the thermal head so that the thermal head performs printing one time while the pulse motor is operated one step, the second head control mode being adapted to control the thermal head so that the thermal head performs printing two times while the pulse motor is operated three steps.

5. The apparatus of claim 1 wherein:

the head detection unit includes a clock signal transmitting unit which transmits a clock signal after transmitting a low clock signal for a predetermined number of dots to the thermal head, the former clock signal being alternately high and low at given periods; a data signal transmitting unit which transmits a data input signal to one end of the plurality of heating elements simultaneously with the transmission of a first high to the thermal head by the clock signal transmitting unit, the data input signal being high for the first dot and low for the rest of the dots; a data signal receiving unit which receives the data input signal from the other end of the plurality of heating elements, the data input signal being shifted one dot by the rising of the alternately high and low clock signal; and a judgment unit which judges that a particular thermal head is attached in the case where the data signal receiving unit receives the data input signal synchronously with the clock signal of the order corresponding to the number of dots equivalent to the heating elements arranged in the particular thermal head.

* * * * *